US007230587B2

(12) United States Patent
Onozawa et al.

(10) Patent No.: US 7,230,587 B2
(45) Date of Patent: Jun. 12, 2007

(54) PLASMA DISPLAY DEVICE

(75) Inventors: Makoto Onozawa, Kawasaki (JP); Hideaki Ohki, Yokohama (JP); Masaki Kamada, Yokohama (JP); Takashi Shiizaki, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 10/780,579

(22) Filed: Feb. 19, 2004

(65) Prior Publication Data

US 2004/0222747 A1 Nov. 11, 2004

(30) Foreign Application Priority Data

May 9, 2003 (JP) ..... 2003-131879

(51) Int. Cl.
*G09G 3/28* (2006.01)

(52) U.S. Cl. ..... 345/60; 345/60; 345/62; 315/169.3

(58) Field of Classification Search .. 315/169.1–169.4; 345/55, 60, 204
See application file for complete search history.

(56) References Cited

U.S. PATENT DOCUMENTS 5,670,974 A * 9/1997 Ohba et al. ..... 345/60
6,011,355 A * 1/2000 Nagai ..... 315/169.3
2001/0033257 A1* 10/2001 Shin ..... 345/60
2002/0175883 A1* 11/2002 Onozawa et al. ..... 345/67

FOREIGN PATENT DOCUMENTS

| | | |
|---|---|---|
| DE | 100 10 957 | 9/2001 |
| EP | 1 065 650 | 1/2001 |
| JP | 8-46053 | 2/1996 |
| JP | 2000-330514 | 11/2000 |
| JP | 2002-016486 | 1/2002 |
| JP | 2002-16486 | 1/2002 |

OTHER PUBLICATIONS

European Search Report, dated Feb. 16, 2007, and issued in corresponding European Patent Application No. 04251133.7-2205.

* cited by examiner

*Primary Examiner*—David Vu
*Assistant Examiner*—Dieu Hien Duong
(74) *Attorney, Agent, or Firm*—Staas & Halsey LLP

(57) ABSTRACT

In a plasma display device having a reduced discharge-current-induced voltage fluctuation and an expanded drive margin and being successful in preventing the display characteristics from being degraded, a Y-electrode drive circuit and an X-electrode drive circuit for supplying a drive voltage to the capacitance which represents a display cell are configured using parallel circuits in which first switching elements having a high-speed-switching performance and second switching elements having a low-saturation-voltage performance are connected in parallel, so that the second switching elements having the low-saturation-voltage performance are turned on at least during a period that discharge current flows therebetween.

34 Claims, 10 Drawing Sheets

PLASMA DISPLAY DEVICE

CROSS-REFERENCE TO RELATED APPLICATIONS

This application is based upon and claims the benefit of priority from the prior Japanese Patent Application No. 2003-131879, filed on May 9, 2003, the entire contents of which are incorporated herein by reference.

BACKGROUND OF THE INVENTION

1. Field of the Invention

The present invention relates to a plasma display device.

2. Description of the Related Art

In conventional plasma display devices, power MOSFET (Metal-Oxide Semiconductor Field Effect Transistor) has been a most general output element for their sustain circuits. In contrast to this, some of recent sustain circuits of the plasma display devices phase into use of IGBT (Insulated Gate Bipolar Transistor) having both of input characteristic, which is an advantage of power MOSFET, and low-saturation voltage characteristic, which is an advantage of bipolar transistor, with a shortened turn-off time (for example, see Patent Document. 1 (Japanese Patent Application Laid-Open No. 2000-330514)).

Another proposal is made on an IGBT-incorporated driver IC for driving the plasma displays in which a power MOSFET and an IGBT are connected in a form of totem pole connection (for example, see Patent Document 2 (Japanese Patent Application Laid-Open No. Hei 8-4605.3)).

The IGBT, characterized by its conductivity modification effect just like bipolar transistors, can lower the saturation voltage under current supply. The IGBT can thus realize a basic operation as an output device of the sustain circuit of the plasma display devices through reduction in the turn-off time. The IGBTs currently commercialized are certainly reduced in the turn-off time as compared with the conventional ones, but are still inferior to the power MOSFET because they are longer both in the turn-on time and turn-off time, and are thus disadvantageous in the switching loss.

In consideration of the above situation, a proposal has been made on an inverter for air conditioners, which comprises a power MOSFET which is brought into a conduction state when applied with a first drive voltage, and an IGBT which is brought into a conduction state when applied with a second drive voltage having a different level from that of the first drive voltage, where the power MOSFET and the IGBT are connected in parallel with respect to current supplied to a load (for example, see Patent Document 3 (Japanese Patent Application Laid-Open No. 2002-16486)). In the above-described inverter for air conditioners, the first drive voltage, which drives the power MOSFET only, is applied to the gate electrode when the current to be supplied to the load is relatively small, whereas the second drive voltage, which drives mainly the IGBT and is larger than the first drive voltage is applied to the gate electrode when the current to be supplied to the load is relatively large.

In the technology disclosed in the Patent Document 3, both of the power. MOSFET and IGBT are driven during a large-current driving (start-up) of the inverter for air conditioners or the like. Whereas during a small-current driving (stationary driving) of the inverter for air conditioners or the like, the IGBT is turned off, and only the power MOSFET is driven so as to reduce the power loss during the stationary driving.

The circuit disclosed in the Patent Document 3 applied to the plasma display devices operates during the stationary driving so as to turn off the IGBT and activate only the power MOSFET, so that it can ensure only a small drive margin as being affected by voltage fluctuation due to discharge current. This may consequently result in degradation in the display characteristics which is typified by generation of noise or flicker. In particular the plasma display devices having a screen size of typically 42 inches or larger tend to suffer from a large voltage fluctuation ascribable to the discharge current, and are highly causative of degradation in the display characteristics.

SUMMARY OF THE INVENTION

The present invention is conceived after considering the above-described problems, and an object thereof resides in expanding the drive margin by reducing the voltage fluctuation ascribable to the discharge current, and in preventing degradation in the display characteristics of the plasma display devices.

A plasma display device of the present invention comprises a plurality of first electrodes; a plurality of second electrodes disposed nearly in parallel with the plurality of first electrodes so as to configure a display cell together therewith, and so as to activate electric discharge between themselves and the first electrode composing the display cell; a first electrode drive circuit for applying discharge voltage to the plurality of first electrodes; and a second electrode drive circuit for applying discharge voltage to the plurality of second electrodes. At least either one of the first and second electrode drive circuits comprises a parallel circuit in which a first switching element having a high-speed switching performance and a second switching element having a low-saturation-voltage performance are connected in parallel.

According to this invention, the second switching element having a low-saturation-voltage performance, which is connected in parallel with the first switching element having a high-speed switching performance, is brought into a conductive state when discharge current flows between the first electrode and second electrode, and this allows the discharge current to flow through the second switching element and can successfully reduce the voltage fluctuation. This consequently expands the drive margin of the plasma display devices and prevents degradation in the display characteristics.

On the other hand, both of the first switching element having a high-speed switching performance and the second switching element having a low-saturation-volt age performance are allowed to operate at the time of rising-up or falling-down of sustain pulses, so as to supply current mainly to the first switching element having a fast switching speed, and this successfully reduces the switching loss at the time of rising-up or falling-down of the sustain pulses.

DETAILED DESCRIPTION OF THE PREFERRED EMBODIMENTS

The next paragraphs will specifically describe preferred embodiments of the present invention referring to the attached drawings.

(First Embodiment)

Figure 1:
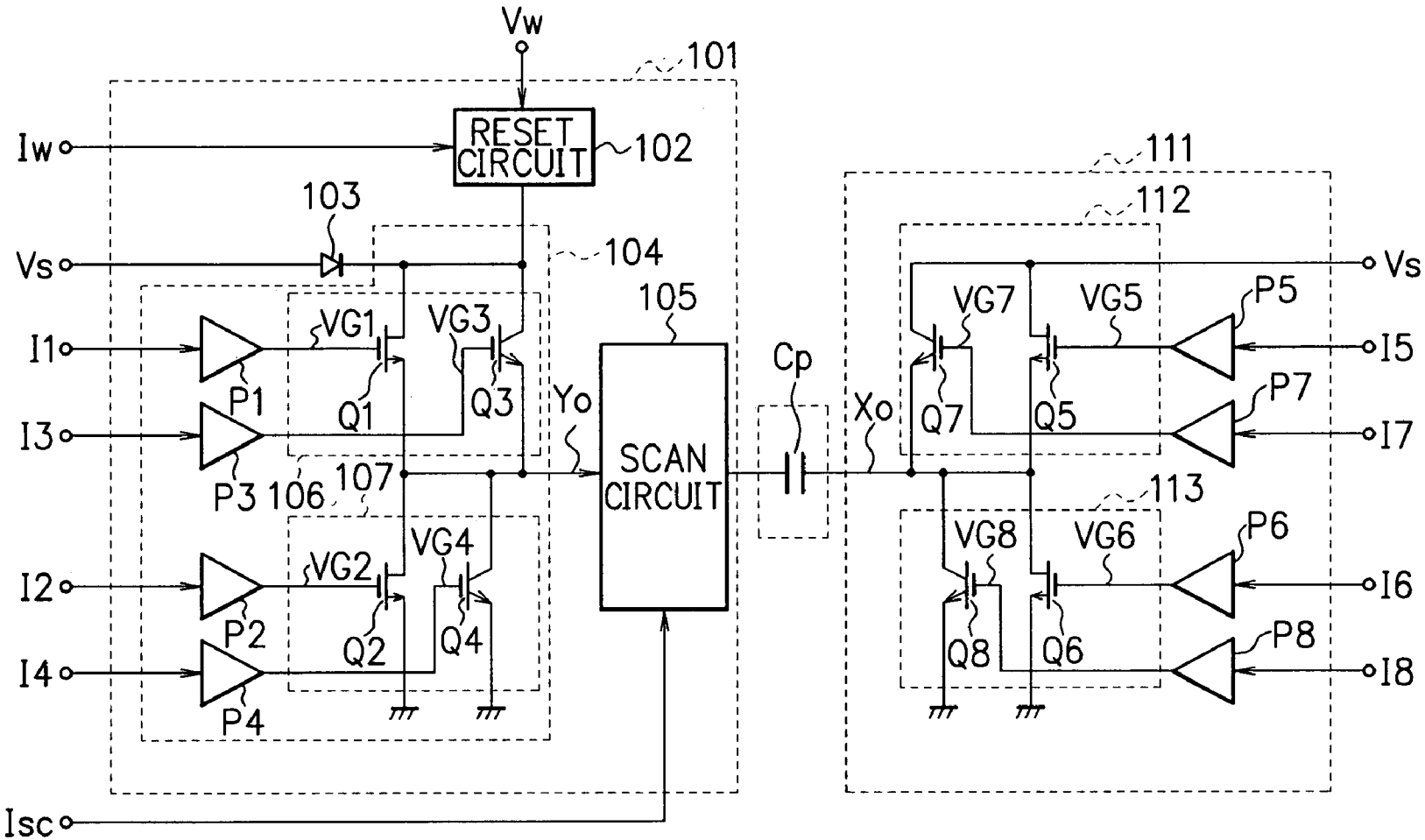
FIG. 1 is a block diagram of an exemplary configuration of a plasma display device according to a first embodiment.

FIG. 1 is a block diagram of an exemplary configuration of a plasma display device according to the first embodiment of the present invention. FIG. 1 show a Y-electrode drive circuit and an X-electrode drive circuit of the plasma display device.

In FIG. 1, Cp represents a capacitive load which symbolizes a display cell composed of X electrodes and Y electrodes of a plasma display panel. A Y electrode drive circuit 101 which supplies drive voltage to one end of the capacitive load Cp has a reset circuit 102, a Y sustain circuit 104 and a scan circuit 105. The X electrode drive circuit which supplies drive voltage to the other end of the capacitive load Cp has an X sustain circuit 111.

The reset circuit 102 outputs a reset voltage supplied from a reset voltage terminal Vw depending on a control signal received from a reset signal terminal Iw.

The Y sustain circuit 104 comprises predrive circuits P1 to P4 and switching elements Q1 to Q4. The Y sustain circuit 104 is supplied with source voltage through a diode 103 from a source voltage terminal Vs. The diode 103 is provided in order to prevent back-flow of current when the reset voltage is supplied from the reset circuit 102.

The first to fourth predrive circuits P1 to P4 are amplifying circuits for amplifying control signals received from the first to fourth control signal terminals I1 to I4. The first to fourth switching elements Q1 to Q4 are turned on or turned off (opened or closed) in response to control signals (gate voltages) VG1 to VG4 output from the first to fourth predrive circuits P1 to P4. The first to fourth switching elements Q1 to Q4 will be detailed later.

The scan circuit 105 is supplied with a drive voltage Yo output from the Y sustain circuit 104, and supplies voltage to one end of the capacitive load Cp depending on a control signal received from a scan signal terminal Isc.

The first and second switching elements Q1, Q2 are switching elements having a high-speed switching performance (short switching time typified by a short turn-on time and a short turn-off time). On the other hand, the third and fourth switching elements Q3, Q4 are switching elements having a low-saturation-voltage performance, that is having a small potential difference between input and output of the switching element under current supply. FIG. 1 shows an exemplary case in which the first and second switching elements Q1, Q2 are configured as N-channel power MOSFETs (metal-oxide-semiconductor field effect transistors), and the third and fourth switching elements Q3, Q4 are configured as IGBTs (insulated-gate bipolar transistors).

The gate or base of the i-th (i is an integer from 1 to 4) switching element Qi is connected to the output side of the i-th predrive circuit Pi. The drain of the first switching element Q1 and the collector of the third switching element Q3 are commonly connected to the cathode of the diode 103, and to the interconnection point, the output terminal of the reset circuit 102 is connected. The source of the second switching element Q2 and the emitter of the fourth switching element Q4 are connected to the ground terminals. The source of the first switching element Q1, the drain of the second switching element Q2, the emitter of the third switching element Q3 and the collector of the fourth switching element Q4 are commonly connected to the input terminal (signal line Yo) of the scan circuit 105.

The first and third switching elements Q1, Q3 herein configure a high-side (higher-potential-side) switching circuit 106 for supplying a high-level voltage of sustain pulse as described later, and the second and fourth switching elements Q2, Q4 configure a low-side (lower-potential-side) switching circuit 107 for supplying a low-level voltage of the sustain pulse. In other words, the high-side switching circuit 106 and the low-side switching circuit 107 in the present embodiment are individually composed of a parallel circuit of a switching element having a high-speed switching performance (power MOSFET, for example) and a switching (element having a low-saturation-voltage performance (IGBT, for example).

It is preferable that the switching element having a high-speed switching performance and the switching element having a low-saturation-voltage performance, which are connected in parallel, have input threshold voltages almost equal to each other. The input threshold voltages herein refer to threshold voltages in the on state and off state of the individual switching elements.

The X sustain circuit 111 has predrive circuits P5 to P8 and switching elements Q5 to Q8, similarly to the Y sustain circuit 104. The fifth to eighth predrive circuits P5 to P8 are amplifying circuits for amplifying control signals received from the fifth to eighth control signal terminals I5 to I8. The fifth to eighth switching elements Q5 to Q8 are turned on or turned off in response to control signals (gate voltages) VG5 to VG8 output from the fifth to eighth predrive circuits P5 to P8.

The fifth and sixth switching elements Q5, Q6 are switching elements having a high-speed switching performance, and the seventh and eighth switching elements Q7, Q8 are switching elements having a low-saturation-voltage performance. FIG. 1 shows an exemplary case in which the fifth and sixth switching elements Q5, Q6 are configured as N-channel power MOSFETs, and the seventh and eighth switching elements Q7, Q8 are configured as IGBTS.

The gate or base of the j-th (j is an integer from 5 to 8) switching element Qj is connected to the output side of the j-th predrive circuit Pj. The drain of the fifth switching element Q5 and the collector of the seventh switching element Q7 are commonly connected to the source voltage terminal Vs to which the source voltage is applied, and the source of the sixth switching element Q6 and the emitter of the eighth switching element Q8 are connected to the ground terminals. The source of the fifth switching element Q5, the drain of the sixth switching element Q6, the emitter of the seventh switching element Q7 and the collector of the eighth switching element Q8 are commonly connected to a signal line Xo for supplying the drive voltage to the other end of the capacitive load Cp.

The fifth and seventh switching elements Q5, Q7 herein configure a high-side switching circuit 112 for supplying a high-level voltage of sustain pulse, and the sixth and eighth switching elements Q6, Q8 configure a low-side (lower-potential-side) switching circuit 113 for supplying a low-level voltage of the sustain pulse. In other words, the high-side switching circuit 112 and the low-side switching circuit 113 in the present embodiment are individually composed of a parallel circuit of a switching element having a high-speed switching performance and a switching element having a low-saturation-voltage performance. It is preferable that the switching element having a high-speed switching performance and the switching element having a low-saturation-voltage performance, which-are connected in parallel, have input threshold voltages almost equal to each other.

Figure 2:
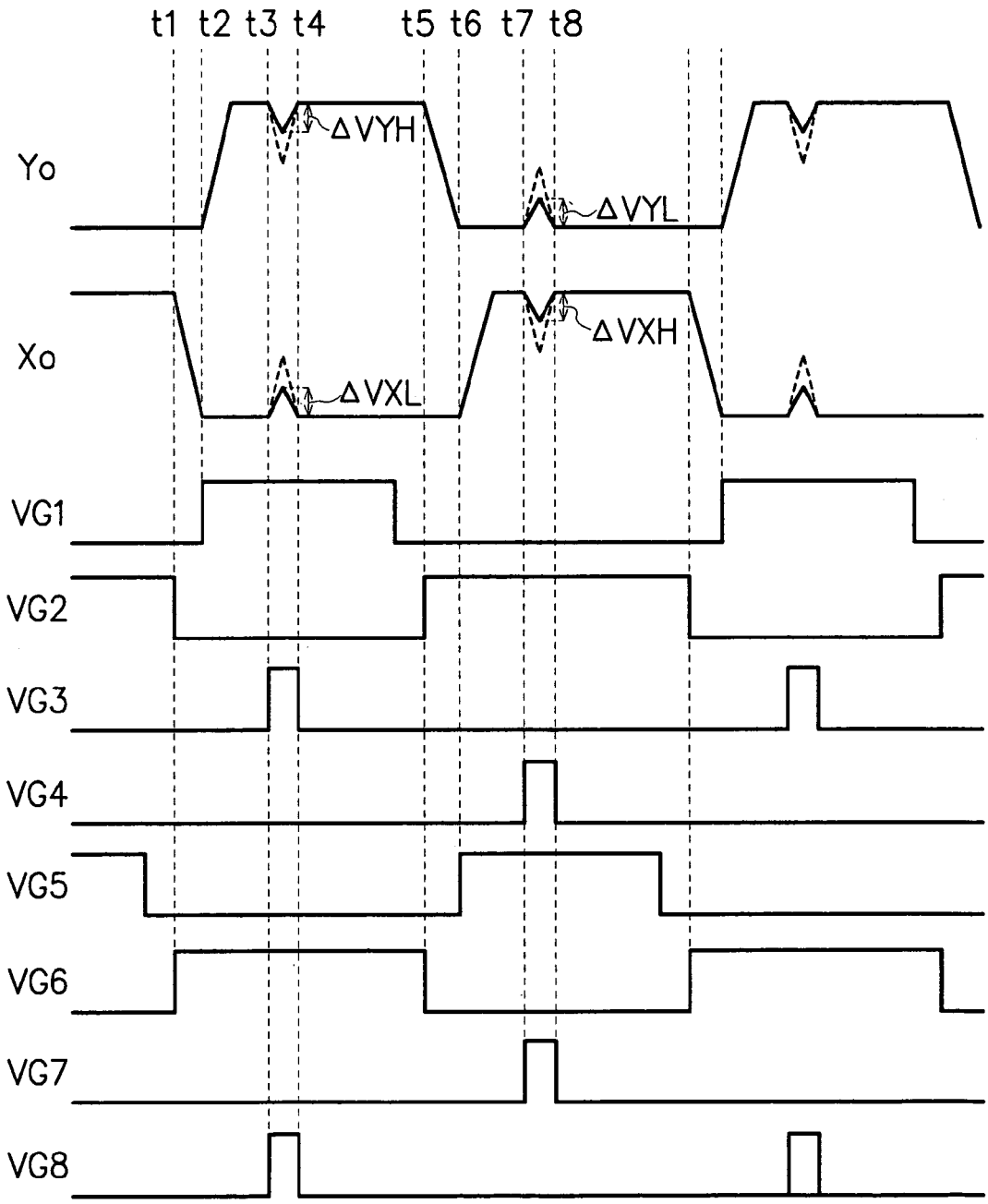
FIG. 2 is a waveform chart showing operational waveforms of the plasma display device according to the first embodiment.

FIG. 2 is a waveform chart showing operations of the X-electrode drive circuit and Y-electrode drive circuit shown in FIG. 1, and more specifically showing operations in the sustain period (period of sustained discharge) in the operation of the plasma display device. In the sustain period, the reset circuit 102 is not activated while being controlled by the control signals received respectively from the reset signal terminal Iw and the scan signal terminal Isc, so that the scan circuit 105 produces a parallel output of the output voltage of the Y sustain circuit 104 to the individual Y electrodes.

In FIG. 2, Yo represents output voltage of the Y-electrode drive circuit (Y sustain circuit 104), and Xo represents output voltage of the X-electrode drive circuit (X sustain circuit 111). VG1 to VG8 represent gate voltages output from the predrive circuits P1 to P8, which are intended for driving the individual switching elements Q1 to Q8, where high level of these gate voltages VG1 to VG8 results in on state (conductive state) of the switching elements Q1 to Q8.

At time point t1, the switching element Q6 of the X sustain circuit 111 turns on, while leaving all of the switching elements other than the switching element Q6 turned off. This brings the output voltage Xo of the X sustain circuit 111 into the low level. On the other hand, the output voltage Yo of the Y sustain circuit 104, having a floating state, is kept at the low level.

At time point t2, the switching element Q1 of the Y sustain circuit 104 turns on. This brings the output voltage Yo of the Y sustain circuit 104 into the high level.

At time point t3 the discharge current flows in the plasma display device after the elapse of a predetermined time period, the switching element Q3 of the Y sustain circuit 104 and the switching element Q8 in the X sustain circuit 111 turn on. That is, the switching elements (IGBT) Q3, Q8, which have a low-saturation-voltage performance and are respectively connected in parallel with the switching elements (power MOSFET) Q1, Q6, which have a high-switching-speed performance and are under the conductive state at time point t3, turn on. It is to be noted that the time point the discharge current flows in the plasma display device is properly determined typically based on the structure or drive voltage of the plasma display device.

By turning the switching elements Q3, Q8 on when the discharge current flows as described in the above, voltage fluctuations ΔVYH, ΔVXL of the sustain pulses (output voltages Yo, Xo) ascribable to the discharge current can be reduced as shown in FIG. 2. It is to be noted that FIG. 2 also shows, for reference and comparison, voltage fluctuation of the output voltages Yo, Xo when switching elements Q3, Q8 are constantly kept turned off (or the switching elements Q3, Q8 are not provided) by broken lines.

At time point t4, both of the switching elements Q3, Q8 are turned off. The switching element Q1 is then turned off, and thereby the output voltage Yo of the Y sustain circuit 104 is kept at the high level (floating state).

At time point t5, the switching element Q2 turns on, and the switching element Q6 turns off. This makes the output voltage Yo of the Y sustain circuit 104 kept at the low level. Because the switching elements Q5 to Q8 are turned off, the output voltage Xo of the X sustain circuit 111 is also kept at the low level (floating state).

At time point t6, the switching element Q5 of the X sustain circuit 111 turns on. This brings the output voltage Xo of the X sustain circuit 111 into the high level.

At time point t7 the discharge current flows after the elapse of a predetermined time period, the switching element Q4 of the Y sustain circuit 104 and the switching element Q7 in the X sustain circuit 111 turn on. That is, the switching elements (IGBT) Q4, Q7, which have a low-saturation-voltage performance and are respectively connected in parallel with the switching elements (power MOSFET) Q2, Q5, which have a high-switching-speed performance and are under the conductive state at time point t7, turn on. This successfully reduces voltage fluctuations ΔVYL, ΔVXH of the sustain pulses (output voltages Yo, Xo) ascribable to the discharge current. It is to be noted that voltage fluctuation of the output voltages Yo, Xo when switching elements Q4, Q7 are constantly kept turned off (or the switching elements Q4, Q7 are not provided) is shown with broken lines for reference and comparison.

At time point t8, both of the switching elements Q4, Q7 are turned off. The switching element Q5 is then turned off, and thereby the output voltage Xo of the X sustain circuit 111 is kept at the high level (floating state). Further thereafter the switching element Q2 is turned off.

The above-described operations will be repeated thereafter depending on the number of times of application of the sustain pulses during the sustain period.

As has been described in the above, the plasma display device can reduce the voltage fluctuations ΔVYH, ΔVYL, ΔVXH, ΔVXL ascribable to the discharge current when it flows, by turning the switching element (IGBT) having a low-saturation-voltage performance on, and thereby can expand the drive margin of the plasma display device. On the other hand, at the time of rising-up or falling-down of sustain pulses, the switching element (power MOSFET) which has a high-speed switching performance and is connected in parallel with the switching element having a low-saturation-voltage performance, is allowed to operate, and this is more successful in reducing the switching loss in association with changes in the sustain pulses, as compared with the case where the switching element having a low-saturation-voltage performance is used alone.

The plasma display device shown in FIG. 2 is configured so as to turn the switching element (IGBT) having a low-saturation-voltage performance on, only when the discharge current flows in the plasma display device, where it is only required that the element is turned on at least when the discharge current flows in the plasma display device, but the ON state thereof during any other periods will not be prohibited.

FIG. 2 shows only an exemplary case in which the output voltages Yo, Xo are changed so that either one of them is changed from the high level down to the low level, and thereafter the other is changed from the low level up to the high level, where the timing of changes in the output voltages Yo, Xo may be the same, or may be inverted from that shown in FIG. 2.

Figure 3:
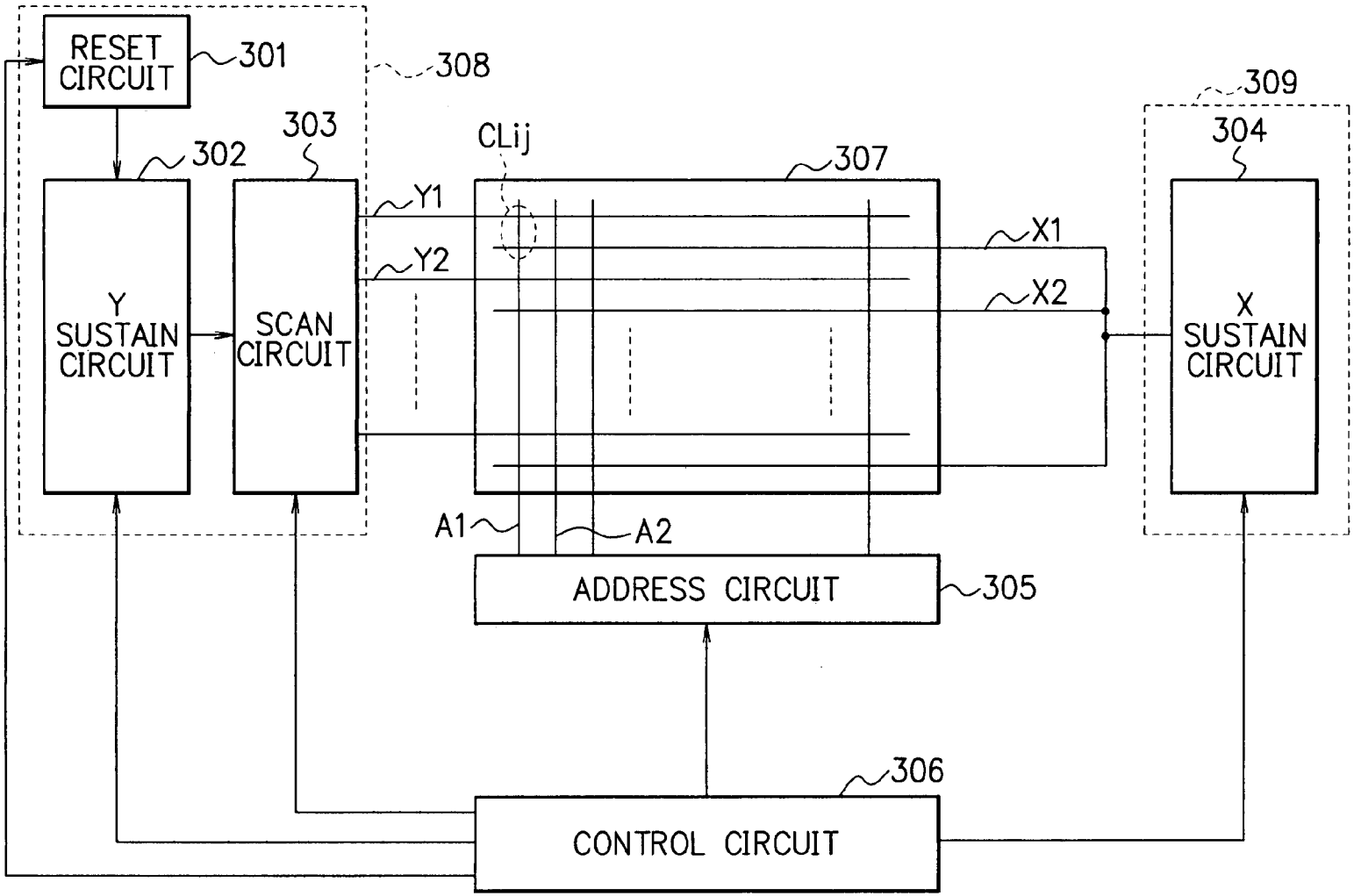
FIG. 3 is a block diagram of an exemplary overall configuration of a plasma display device applied with the configuration shown in FIG. 1.

FIG. 3 is a block diagram of an exemplary configuration of a plasma display device applied with the drive circuit shown in FIG. 1. A reset circuit 301, a Y sustain circuit 302, a scan circuit 303 and an X sustain circuit 304 shown in FIG. 3 correspond to the reset circuit 102, the Y sustain circuit 104, the scan circuit 105 and the X sustain circuit 111 shown in FIG. 1, respectively. The reset circuit 301, the Y sustain circuit 302 and the scan circuit 303 configure a Y-electrode drive circuit 308, and the X sustain circuit 304 configures an X-electrode drive circuit 309.

A control circuit 306 generates a control signal based on an externally-supplied unillustrated clock signal, a horizontal synchronizing signal, a vertical synchronizing signal, a display data and so forth. The control circuit 306 then outputs thus-generated control signal to the reset circuit 301, Y sustain circuit 302, scan circuit 303, X sustain circuit 304 and address circuit 305.

The output terminal of the X sustain circuit 304 is commonly connected to X electrodes X1, X2 . . . so as to drive them as being controlled by a control signal. The Y-electrode drive circuit 308 comprises the reset circuit 301, Y sustain circuit 302 and scan circuit 303. The Y-electrode drive circuit 308 drives Y electrodes Y1, Y2 . . . as being controlled by a control signal. The address circuit 305 drives address electrodes A1, A2 . . . as being controlled by a control signal.

A display panel (plasma display panel: PDP) 307 is configured so that the X electrodes X1, X2 . . . and Y electrodes Y1, Y2 . . . are alternately disposed almost in parallel with each other, and the address electrodes A1, A2 . . . are disposed normal to these electrodes to thereby form a two-dimensional matrix., Each display cell (pixel) CLij corresponded to the capacitive load Cp shown in FIG. 1 comprises one X electrode Xi, one Y electrode Yi and one address electrode Aj.

Figure 4A:
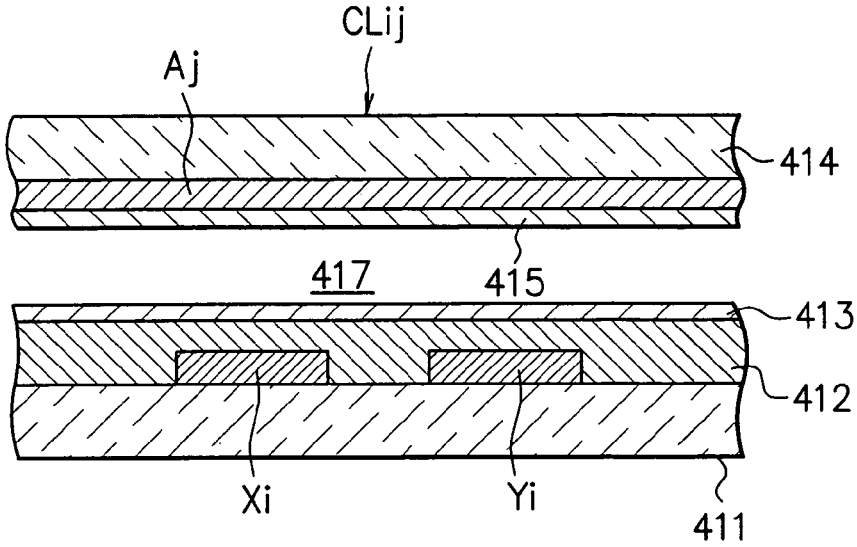
FIGS. 4A to 4C are drawings showing a display cell of the plasma display device shown in FIG. 3.

FIG. 4A is a sectional view of a configuration of the display cell CLij shown in FIG. 3. The X electrode Xi and Y electrode Yi are formed on a front glass substrate 411. A dielectric material layer 412 for ensuring insulation from a discharge space 417 is deposited thereon, and an MgO (magnesium oxide) protective film 413 is formed further thereon.

On the other hand, the address electrode Aj is formed on a rear glass substrate 414 disposed so as to oppose with the front glass substrate 411, a dielectric material layer 415 is deposited thereon, and a fluorescent body is deposited further thereon. The discharged space 417 between the MgO protective film 413 and dielectric material layer 415 is filled typically with an Ne+Xe Penning gas.

Figure 4B:
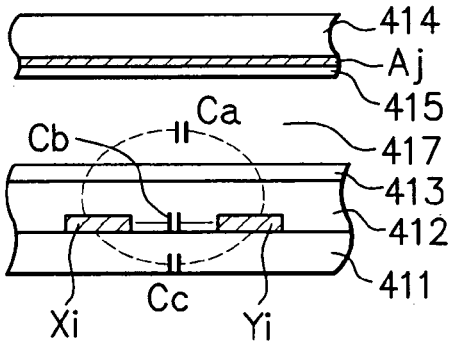

FIG. 4B is a schematic drawing for explaining capacitance CL of an AC-driven plasma display device. Ca represents a capacitance of the discharge space 417 between the X electrode Xi and Y electrode Yi, Cb represents a capacitance of the dielectric material layer 412, and Cc represents a capacitance of the front glass substrate 411 between the X electrode Xi and Y electrode Yi. Capacitance CL between the electrodes Xi and Yi is determined by the total of these capacitances Ca, Cb and Cc.

Figure 4C:
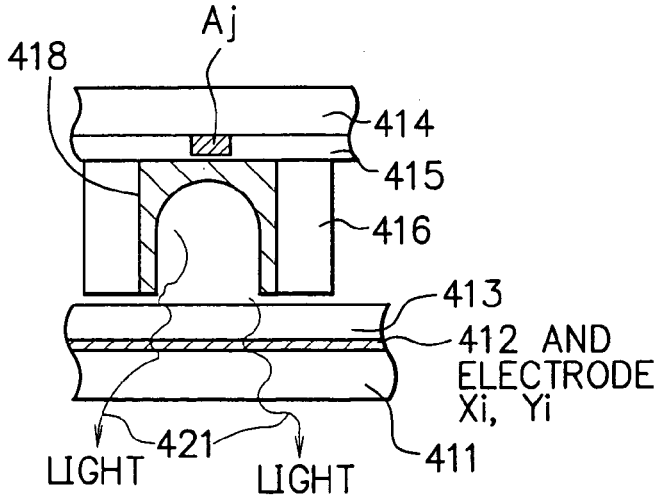

FIG. 4C is a schematic drawing for explaining light emission of the AC-driven plasma display device. Stripe-patterned ribs 416 are arranged, where each rib has either of red, green and blue fluorescent materials 418 coated on the inner surface thereof, so as to allow the fluorescent material 418 to emit light 421 when excited by the electric discharge activated between the X electrode Xi and Y electrode Yi.

Figure 5:
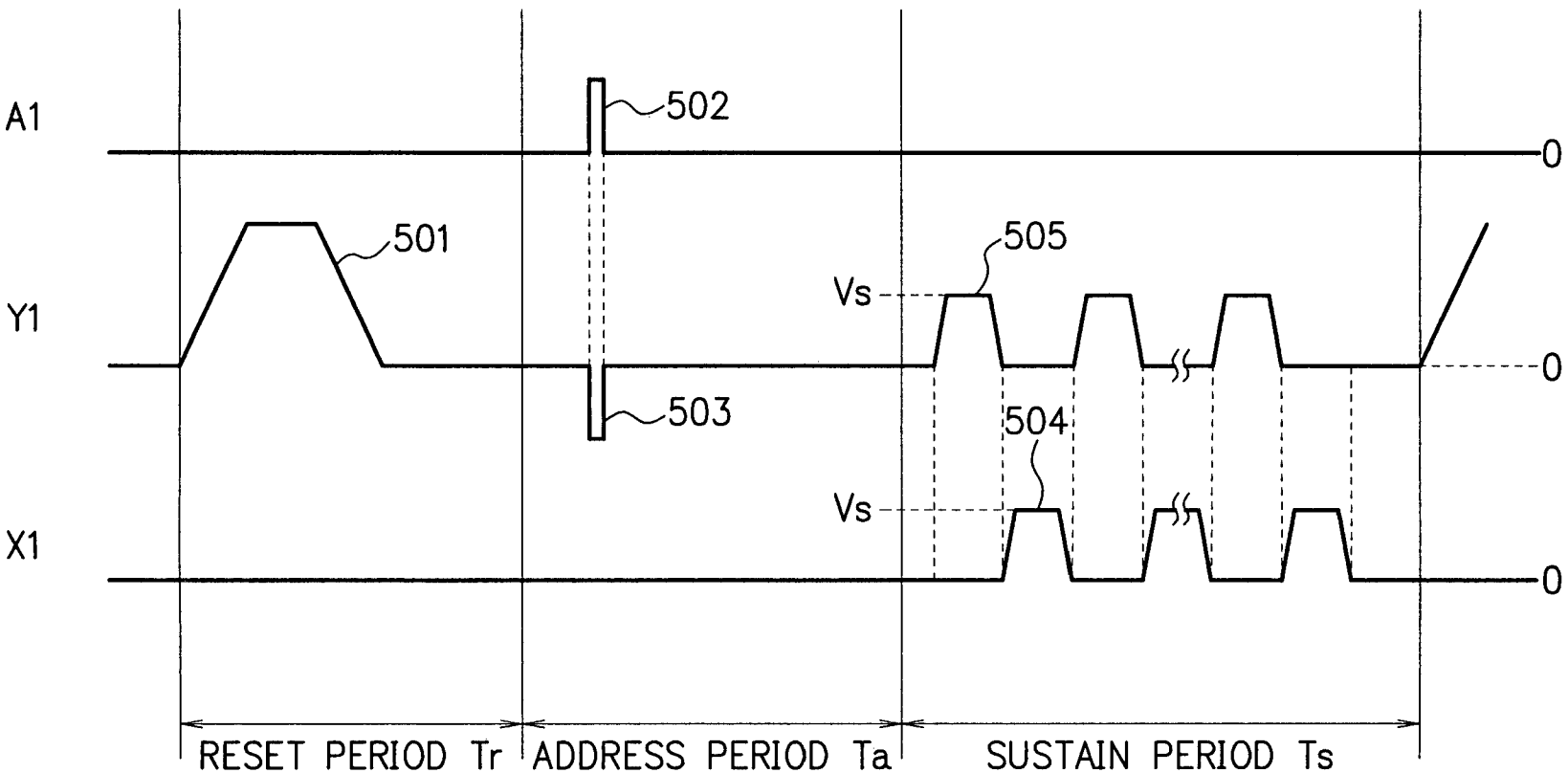
FIG. 5 is a waveform chart showing operational waveforms of the plasma display device shown in FIG. 3.

FIG. 5 is a waveform chart showing operational waveforms of the plasma display device shown in FIG. 3.

The X sustain circuit 304 in the X-electrode drive circuit 309 outputs X sustain pulses 504 generated in the sustain period Ts to the X electrode Xi. The Y sustain circuit 302 in the Y-electrode drive circuit 308 outputs Y sustain pulses 505 generated in the sustain period Ts to the Y electrode Yi.

The reset circuit 301 in the Y-electrode drive circuit 308 outputs a reset pulse 501 generated in the reset period Tr to the Y electrode Yi. The scan circuit 303 in the Y-electrode drive circuit 308 outputs a scan pulse 503 generated in the address period Ta to the Y electrode Yi. The address circuit 305 outputs an address pulse 502 generated in the address period Ta to the address electrode Aj.

In the reset period Tr, full-screen writing and full-screen erasure of electric charge are carried out by applying the reset pulse 501 to the Y electrode Yi, to thereby form a predetermined wall charge by erasing the display contents for the previous time.

Next in the address period Ta, a positive address pulse 502 is applied to the address electrode Aj, and a negative scan pulse 503 is then applied to desired Y electrodes by sequential scanning. This activates address discharge between the address electrode. Aj and Y electrode Yi, and thereby specifies addresses of the display cells.

Next in the sustain period(period of sustained discharge) Ts, the sustain pulses 504, 505 are alternately applied to the individual X electrodes Xi and the individual Y electrodes Yi so as to apply a sustaining discharge voltage Vs between these electrodes. This activates electric discharge between the X electrode Xi and Y electrode Yi corresponded to the display cell of which address is specified in the address period Ta, and thus causes light emission.

As has been described in the above, the X and Y-electrode drive circuits of the plasma display device of the first embodiment are configured using the parallel circuit in which the switching element (power MOSFET, for example) having a high-speed-switching performance and the switching element (IGBT, for example) having a low-saturation-voltage performance are connected in parallel. When discharge current flows, the plasma display device can turn on the switching element having a low-saturation-voltage performance and can allow the current to flow therethrough, and this successfully reduces voltage fluctuations ΔVYH, ΔVYL, ΔVXH, ΔVXL ascribable to the discharge current. The plasma display device is thus successful in expanding the drive margin by reducing the voltage fluctuation ascribable to the discharge current, and in preventing degradation in the display characteristics of the plasma display devices.

When the sustain pulse rises up or falls down, the device can turn on the switching element having a high-speed switching performance connected in parallel with the switching element having a low-saturation-voltage performance, and can allow the current to flow mainly through the switching element having a high-speed switching performance. This is more successful in reducing the switching loss generable during the turn-on time and turn-off time, as compared with the case where the switching element having a low-saturation-voltage performance is used alone.

The following paragraphs will describe other embodiments.

The configuration and operations of the plasma display device previously shown in FIGS. 3 and 4 are such as those applied with the aforementioned first embodiment, and the essence thereof will apply also to second to fifth embodiments described in the next, except that only the configurations of the Y-electrode drive circuit 308 and X-electrode drive circuit 309 will properly be modified depending on requirements of these embodiments, so that the basic configuration and operations will not be detailed.

(Second Embodiment)

Next paragraphs will describe a second embodiment of the present invention.

Figure 6:
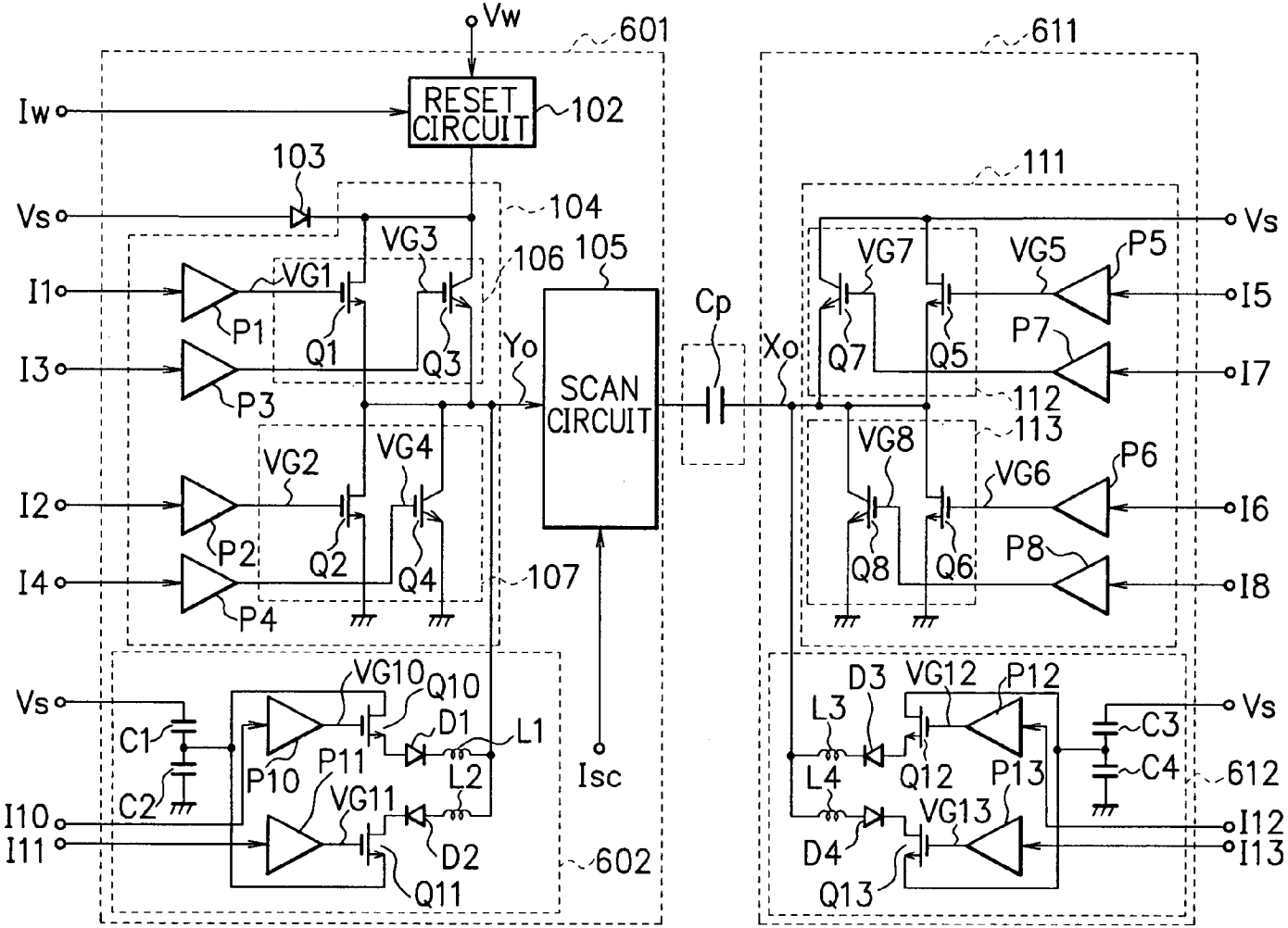
FIG. 6 is a circuit diagram of an exemplary configuration of a plasma display device according to a second embodiment.

FIG. 6 is a circuit diagram of an exemplary configuration of a plasma display device according to a second embodiment of the present invention. FIG. 6 shows the Y-electrode drive circuit and the X-electrode drive circuit of the plasma display device. It is to be noted that the constituents shown in FIG. 6, having functions similar to those of the constituents previously shown in FIG. 1, will be indicated by the same reference numerals, while omitting the repetitive explanation therefor.

As shown in FIG. 6, the second embodiment differs from the first embodiment shown in FIG. 1 only in that each of the Y-electrode drive circuit and X-electrode drive circuit of the first embodiment further comprises a power recovery circuit.

A Y-electrode drive circuit 601 comprises the reset circuit 102, the diode 103, the Y sustain circuit 104, the scan circuit 105 and a power recovery circuit 602 for the Y-electrode drive circuit. The X-electrode drive circuit 611 comprises the X sustain circuit 111 and a power recovery circuit 612 for the X-electrode drive circuit.

The power recovery circuit 602 comprises predrive circuits P10 and P11, switching elements Q10 and Q11, diodes D1 and D2, coils L1 and L2, and capacitors C1, C2 for power recovery.

The capacitors C1, C2 are connected in series between the source voltage terminal Vs and the ground terminal. The predrive circuits P10, P11 are amplifying circuit for amplifying control signals received from control signal terminals 110, 111. Switching elements Q10, Q11 are controlled so as to be turned on or turned off in response to control signals (gate voltages) VG10, VG11. The switching elements Q10, Q11 are typically configured by switching elements having a high-speed switching performance, such as power MOSFET.

The switching element Q10 is configured so that the gate electrode thereof is connected to the output side of the predrive circuit P10, and the drain thereof is connected to the interconnection point of the capacitors C1 and C2. The source thereof is connected to the anode of the diode D1. The cathode of the diode D1 is connected to one end of a coil L1, where the other end of the coil L1 being connected to the signal line Yo.

The switching element Q11 is configured so that the gate electrode thereof is connected to the output side of the predrive circuit P11, and the source thereof is connected to the interconnection point of the capacitors C1 and C2. The drain thereof is connected to the cathode of the diode D2. The anode of the diode D2 is connected to one end of a coil L2, where the other end of the coil L2 being connected to the signal line Yo.

The power recovery circuit 612 comprises predrive circuits P12 and P13, switching elements Q12 and Q13, diodes D3 and D4, coils L3 and L4, and capacitors C3, C4 for power recovery. The power recovery circuit 612 will not be detailed below because it is configured similarly to the power recovery circuit 602, and its constituent predrive circuits P12, P13, switching elements Q12, Q13, diodes D3, D4, coils L3, L4, and capacitors C3, C4 for power recovery correspond with the predrive circuits P12, P13, switching elements Q10, Q11, diodes D1, D2, coils L1, L2, and capacitors C1, C2 for power recovery, respectively.

Figure 7:
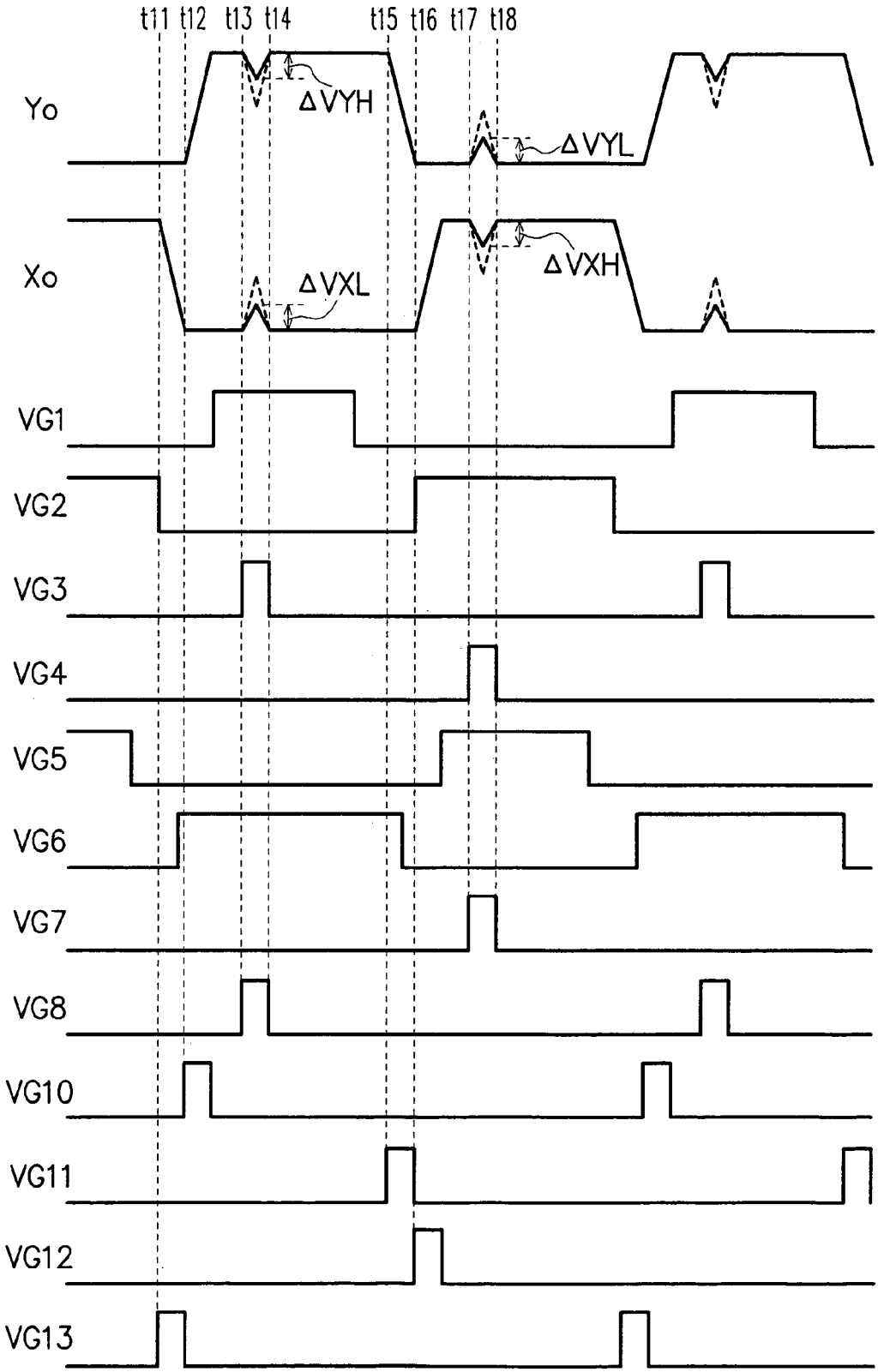
FIG. 7 is a waveform chart showing operational waveforms of the plasma display device according to the second embodiment.

FIG. 7 is a waveform chart showing operational waveforms of the X-electrode drive circuit 611 and Y-electrode drive circuit 601 shown in FIG. 6, and more specifically illustrates operations during the sustain period(period of sustained discharge) in the operation of the plasma display device. In the sustain period, the reset circuit 102 does not operate as being controlled by the control signals respectively received from the reset signal terminal Iw and the scan signal terminal Isc, whereas the scan circuit 105 causes parallel output of the output voltage of the Y sustain circuit 104 to the individual Y electrodes.

In FIG. 7, Yo represents output voltage of the Y-electrode drive circuit 601, and Xo represents output voltage of the X-electrode drive circuit 611. VG1 to VG8 represent gate voltages output from the predrive circuits P1 to P8, intended for driving the individual switching elements Q1 to Q8, and VG10 to VG13 represent gate voltages output from the predrive circuits P10 to P13, intended for driving the individual switching elements Q10 to Q13. The switching elements Q1 to Q8, and Q10 to Q13 are brought into on state (conductive state) when the gate voltages VG1 to VG8, and VG10 to VG13 are kept at the high level.

At time point t11 where the output voltage Xo falls down to the low level, a pulse for activating the switching element Q13 of the X-electrode drive circuit 611 is generated, and thereby the switching element Q6 is turned on after the elapse of a predetermined time period. This brings the output voltage Xo from the high level down to the low level, and power in association to this change is recovered by the power recovery circuit 612.

At time point t12 where the output voltage Yo rises up to the high level, a pulse for activating the switching element Q10 of the Y-electrode drive circuit 601 is generated, and thereby the switching element Q1 is turned on. This successfully makes use of electric power recovered as a part of the electric power for changing the output voltage Yo, so as to allow the output voltage Yo to change from the low level up to the high level.

At time point t13 after the elapse of a predetermined time period where the discharge current flows in the plasma display device, the switching element Q3 of the Y-electrode drive circuit 601 and the switching element Q8 of the X-electrode drive circuit 611 are turned on, similarly to as at time point t3 in FIG. 2. In other words, the switching elements Q3, Q8, which have a low-saturation-voltage performance and are respectively connected in parallel with the switching elements Q1, Q6, which have a high-switching-speed performance and are under the conductive state at time point t13, turn on. This is successful in suppressing the voltage fluctuations ΔVYH, ΔVXL of the sustain pulses (output voltages Yo, Xo) ascribable to the discharge current.

It is to be noted that FIG. 7 also shows, for reference and comparison, voltage fluctuation of the output voltages Yo, Xo when switching elements Q3, Q8 are constantly kept turned off, by broken lines. The time point where the discharge current flows is properly determined depending on the structure and drive voltage of the plasma display device.

At time point t14, both of the switching elements Q3, Q8 are turned off. The switching element Q1 is then turned off, and thereby the output voltage Yo of the Y-electrode drive circuit 601 is kept at the high level.

At time point t15 where the output voltage Yo is changed into the low level, a pulse for activating the switching element Q11 of the Y-electrode drive circuit 601 is generated, and thereby the switching element Q2 is turned on after the elapse of a predetermined time period. This brings the output voltage Yo from the high level down to the low level, and power in association to this change is recovered by the power recovery circuit 602.

At time point t16 where the output voltage Xo is changed into the high level, a pulse for activating the switching element Q12 of the X-electrode drive circuit 611 is generated, and thereby the switching element Q5 is turned on. This successfully makes use of electric power recovered as a part of the electric power for changing the output voltage Xo, so as to allow the output voltage Xo to change from the low level up to the high level.

At time point t17 after the elapse of a predetermined time period where the discharge current flows in the plasma display device, the switching elements Q4, Q7, which have a low-saturation-voltage performance and are respectively connected in parallel with the switching elements Q2, QS, which have a high-switching-speed performance and are under the conductive state at time point t13, turn on. This is successful in suppressing the voltage fluctuations ΔVYL, ΔVXH of the sustain pulses (output voltages Yo, Xo) ascribable to the discharge current. It is to be noted that the broken lines indicate fluctuation in the output voltages Yo, Xo when the switching elements Q4, Q7 are constantly kept turned off.

At time point t18, both of the switching elements Q4, Q7 are turned off. The switching element Q5 is then turned off, and thereby the output voltageXo of the X-electrode drive circuit 611 is kept at the high level. The switching element Q2 is thereafter turned off.

The above-described operations will be repeated thereafter depending on the number of times of application of the sustain pulses during the sustain period.

As has been described in the above, the second embodiment can ensure effects equivalent to those of the aforementioned first embodiment. In addition, at the time of rising-up or falling-down of sustain pulses, the switching element which has a high-speed switching performance and is connected in parallel with the switching element having a low-saturation-voltage performance, is allowed to operate after the power recovery circuits 602, 612 are activated (properly turning the switching elements Q10 to Q13 in the power recovery circuits 602, 612 on), and this is more successful in reducing the switching loss in association with rising-up and falling-down of the sustain pulses.

The plasma display device shown in FIG. 7 is configured so as to turn the switching element (IGBT) having a low-saturation-voltage performance on, only when the discharge current flows in the plasma display device, but it is only required-that the element is turned on at least when the discharge current flows in the plasma display device, and the ON state thereof during any other periods will not be prohibited.

FIG. 7 shows only an exemplary case in which the output voltages Yo, Xo are changed so that either one of them is changed from the high level down to the low level, and thereafter the other is changed from the low level up to the high level, where the timing of changes in the output voltages Xo, Yo may be the same, or may be inverted from that shown in FIG. 7.

(Third Embodiment)

Next paragraphs will describe a third embodiment of the present invention.

Figure 8:
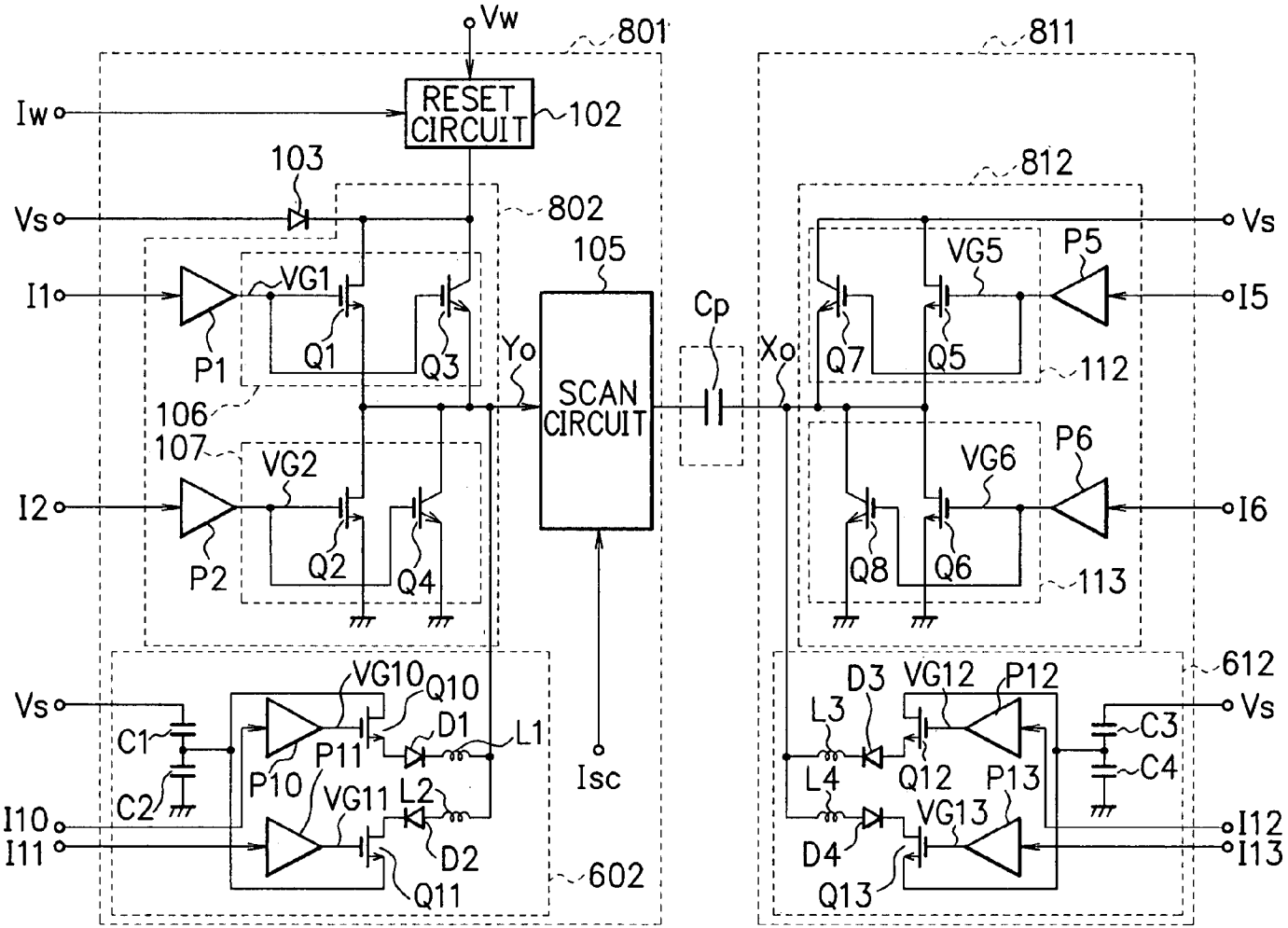
FIG. 8 is a circuit diagram of an exemplary configuration of a plasma display device according to a third embodiment.

FIG. 8 is a circuit diagram of an exemplary configuration of a plasma display device according to a third embodiment of the present invention. FIG. 8 shows the Y-electrode drive circuit and the X-electrode drive circuit of the plasma display device. It is to be noted that the constituents shown in FIG. 8, having functions similar to those of the constituents previously shown in FIGS. 1 and 6, will be indicated by the same reference numerals, while omitting the repetitive explanation therefor.

As shown in FIG. 8, the third embodiment differs from the second embodiment shown in FIG. 6 only in the configuration of a Y sustain circuit 802 in a Y-electrode drive circuit 801, and an X sustain circuit 812 in an X-electrode drive circuit 811.

The Y sustain circuit 802 is configured so that the gate of the first switching element Q1 and the base of the third switching element Q3 are connected to the output side of the first predrive circuit P1, and so that the gate of the second switching element Q2 and the base of the fourth switching element Q4 are connected to the output side of the second predrive circuit P2. The X sustain circuit 812 is configured so that the gate of the fifth switching element Q5 and the base of the seventh switching element Q7 are connected to the output side of the fifth predrive circuit P5, and so that the gate of the sixth switching element Q6 and the base of the eighth switching element Q8 is connected to the output side of the sixth predrive circuit P6.

In other words in the third embodiment, Y sustain circuit 802 is configured so that an identical control signal (gate voltage) VG1 output from the predrive circuit P1 is used for driving the switching elements Q1, Q3, and so that an identical single control signal (gate voltage) VG2 output from the predrive circuit P2 is used for driving the switching elements Q2, Q4, where the predrive circuits P3, P4 are not provided. Similarly, the X sustain circuit 812 is configured so that an identical control signal (gate voltage) VG5 output from the predrive circuit P5 is used for driving the switching elements Q5, Q7, and so that an identical single control signal (gate voltage) VG6 output from the predrive circuit P6 is used for driving the switching elements Q6, Q8, where the predrive circuits P7, P8 are not provided.

As is obvious from the above description, it is necessary to activate mainly the switching elements Q1, Q2, Q5, Q6 having a high-speed-switching performance during the switching operation period, and to activate the switching elements Q3, Q4, Q7, Q8 having a low-saturation-voltage performance at least during a period the discharge current flows. In the third embodiment, the Y-electrode drive circuit and the X-electrode drive circuit are configured using the switching elements Q1 to Q8 in which the input threshold voltage of the switching elements Q1, Q2, Q5, Q6 are equal to or lower than that of the switching elements Q3, Q4, Q7, Q8 connected in parallel therewith. The threshold value herein means threshold voltages in the on state and off state of the individual switching elements.

Operations of the X-electrode drive circuit 811 and the Y-electrode drive circuit 801 shown in FIG. 8 are similar to those in the second embodiment shown in FIG. 7 except that the gate voltages VG3, VG4, VG7, VG8 are not used, where the switching elements Q3, Q4, Q7, Q8 having a low-saturation-voltage performance can be turned on when the discharge current flows in the plasma display device.

As has been described in the above, the third embodiment can ensure effects equivalent to those of the aforementioned first and second embodiments. In addition, the circuit configuration, in which parallel pairs of the switching elements Q1 and Q3, Q2 and Q4, Q5 and Q7, Q6 and Q8 are driven by the control signal (gate voltage) output from the predrive circuits P1, P2, P5, P6, respectively, is successful in reducing the circuit scale, and in facilitating external control.

The Y-electrode drive circuit 801 and the X-electrode drive circuit 811 typically shown in FIG. 8 are provided with the power recovery circuits 602, 612, respectively, where the power recovery circuits 602, 612 are also omissible.

(Fourth Embodiment)

Next paragraphs will describe a fourth embodiment of the present invention.

In the fourth embodiment, a positive source voltage (Vs/2) and a negative source voltage (−Vs/2), respectively having a voltage value with respect to the ground (zero potential) equivalent to half of the sustaining discharge voltage Vs, are used as the source voltage of the sustain circuit, in place of the source voltage Vs of the sustain circuit and the ground in the third embodiment shown in FIG. 8.

Figure 9:
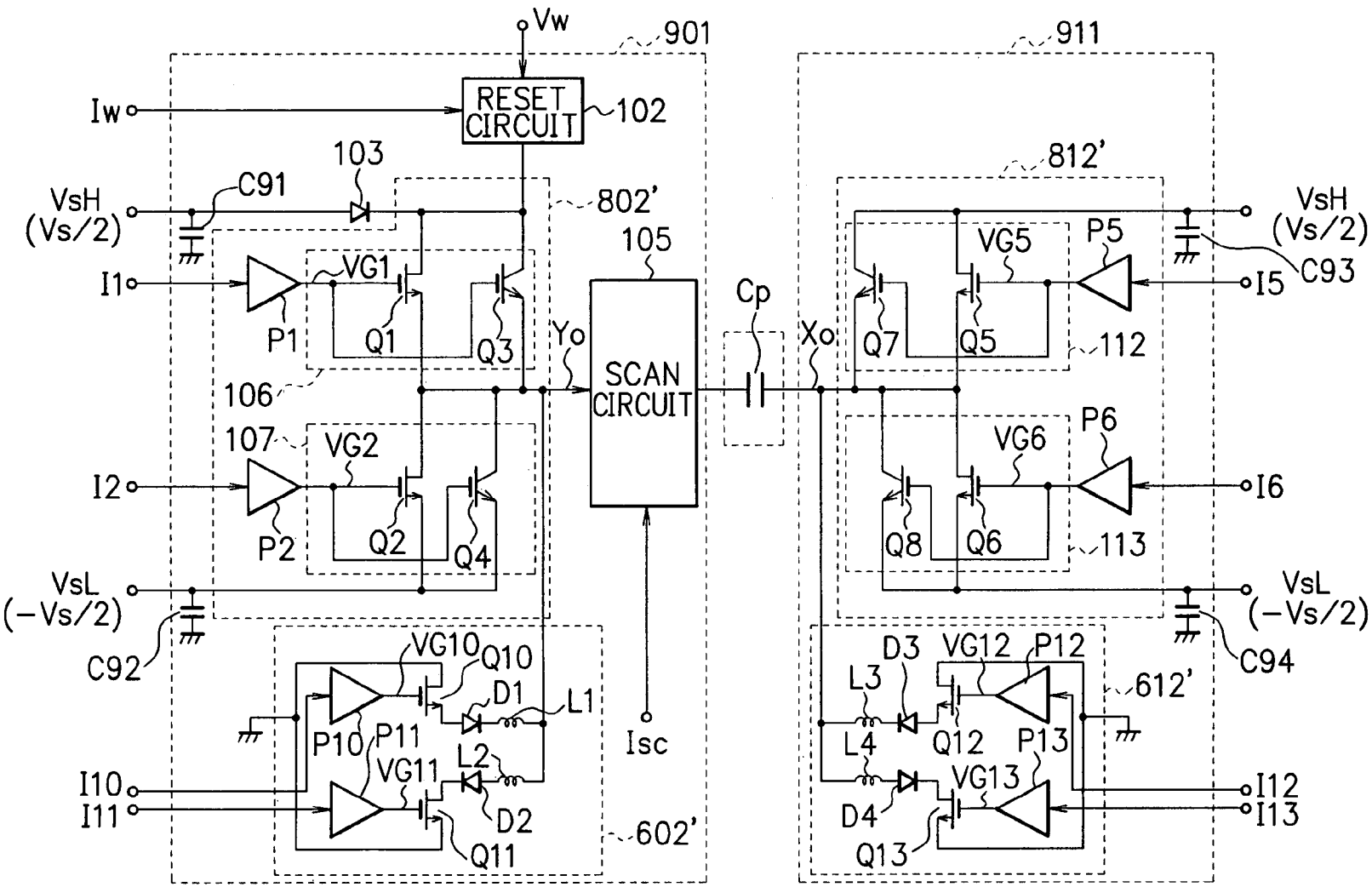
FIG. 9 is a circuit diagram of an exemplary configuration of a plasma display device according to a fourth embodiment.

FIG. 9 is a circuit diagram of an exemplary configuration of a plasma display device according to a fourth embodiment of the present invention. FIG. 9 shows the Y-electrode drive circuit and the X-electrode drive circuit of the plasma display device. It is to be noted that the constituents shown in FIG. 9, having functions similar to those of the constituents previously shown in FIGS. 1, 6 and 8 will be indicated by the same reference numerals, while omitting the repetitive explanation therefor.

As shown in FIG. 9, a Y sustain circuit 802' is supplied with positive source voltage (Vs/2) trough the diode 103 from the source power terminal VsH. The drain of the first switching element Q1 and the collector of the third switching element Q3 are commonly connected to the cathode of the diode 103. The source of the second switching element Q2 and the emitter of the fourth switching element are commonly connected to the source voltage terminal VsL to which negative source voltage (−Vs/2) is input. Other features in the configuration of the Y sustain circuit 802' are similar to those of the Y sustain circuit 802 shown in FIG. 8.

The X sustain circuit 812' is configured so that the drain of the fifth switching element Q5 and the collector of the seventh switching element Q7 are commonly connected to the source voltage terminal VsH to which the positive source voltage (Vs/2) is supplied, and the source of the sixth switching element Q6 and the emitter of the eighth switching element Q8 are commonly connected to the source voltage terminal VsL to which the negative source voltage (−Vs/2) is supplied. Other features in the configuration of the X sustain circuit 812' are similar to those of the X sustain circuit 812 shown in FIG. 8.

C91 and C93 represent bypass capacitors connected between the source voltage terminal VsH and the ground terminal, and C92 and C94 represent bypass capacitors connected between the source voltage terminal VsL and the ground terminal.

By using the positive and negative source voltages as the source voltage of the sustain circuit, the Y-electrode drive circuit 901 and X-electrode drive circuit 911 configured as shown in FIG. 9 can use bypass capacitors C91 to C94, which are generally provided to the power source line, in place of using the power recovery capacitors C1 to C4 used in the power recovery circuits of the aforementioned second and third embodiments. The power recovery circuits 602', 612' can therefore be configured without using power recovery capacitors C1 to C4.

The power recovery circuit 602' is configured similarly to the power recovery circuit 602, where only difference resides in that the drain of the switching element Q10 and the source of the switching element Q11 are connected to the ground terminal. The power recovery circuit 612' is again configured similarly to the power recovery circuit 612, where only difference resides in that the drain of the switching element Q12 and the source of the switching element Q13 are connected to the ground terminal. It is to be noted that the ground terminals independently shown in FIG. 9 for the convenience of the explanation are electrically connected in reality so as to represent a single entity.

The fourth embodiment is therefore successful not only in ensuring effects equivalent to those of the aforementioned first to third embodiments, but also in further reducing the circuit scale because it is no more necessary to provide the power recovery capacitors C1 to C4 to the power recovery circuits 602', 612'.

(Fifth Embodiment)

Next paragraphs will describe a fifth embodiment of the present invention.

Figure 10:
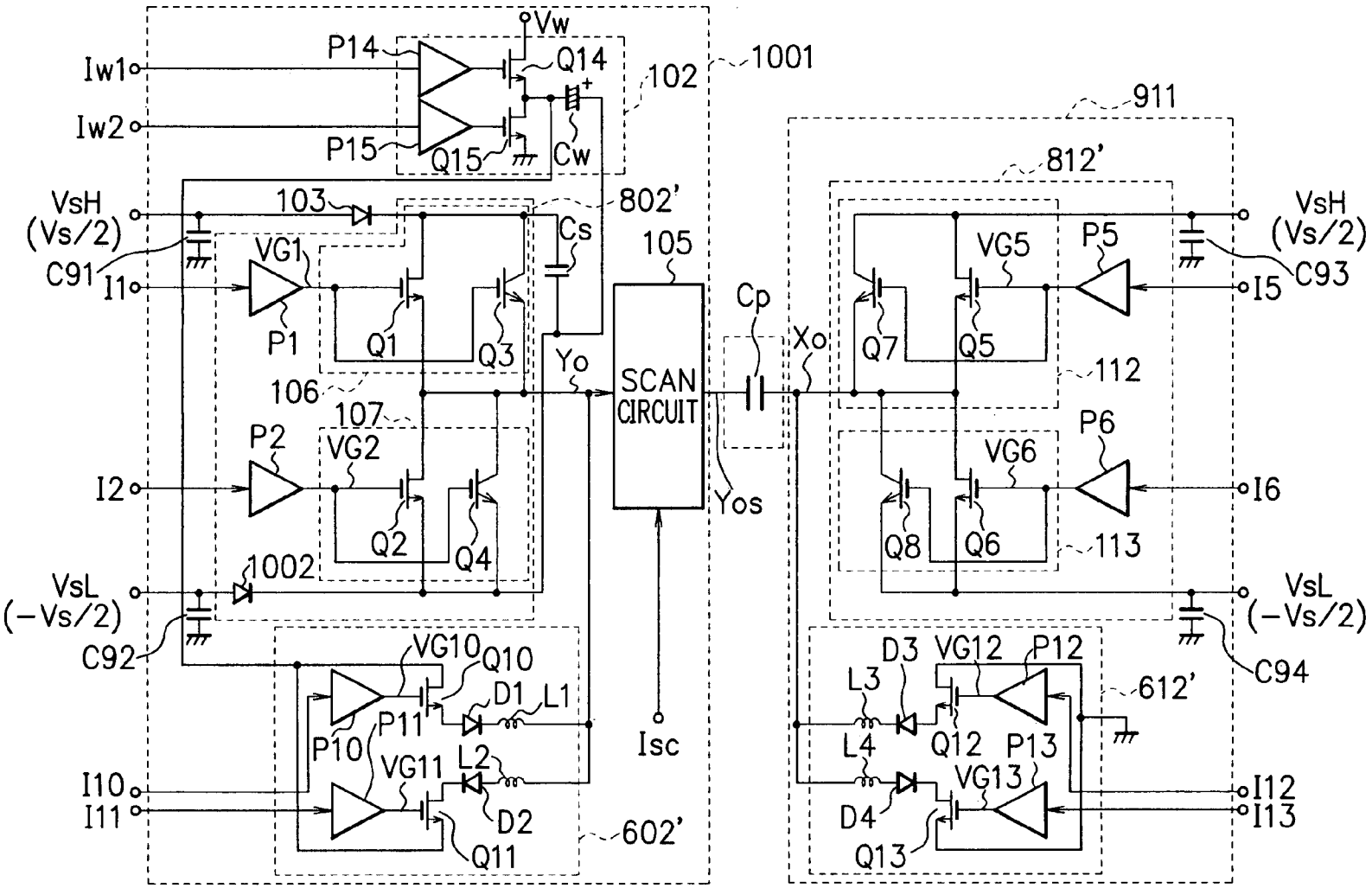
FIG. 10 is a circuit diagram of an exemplary configuration of a plasma display device according to a fifth embodiment.

FIG. 10 is a circuit diagram of an exemplary configuration of a plasma display device according to a second embodiment of the present invention. FIG. 10 shows the Y-electrode drive circuit and the X-electrode drive circuit of the plasma display device. It is to be noted that the constituents shown in FIG. 10, having functions similar to those of the constituents previously shown in FIGS. 1 and 9, will be indicated by the same reference numerals, while omitting the repetitive explanation therefor.

In the fifth embodiment is characterized in that a Y-electrode drive circuit 1001 is configured so that the reset voltage Vw output from the reset circuit 102 is superposed to the source terminal of the switching element Q2 and the emitter terminal of the switching element Q4 in the Y sustain circuit 802'. The following paragraphs will describe the Y-electrode drive circuit 1001, while omitting the explanation for the X-electrode drive circuit 911 having the same configuration with that described in the fourth embodiment.

The reset circuit 102 shown in FIG. 10 comprises predrive circuits P14, P15, switching elements Q14, Q15, and a capacitor Cw.

The predrive circuits P14, P15 are amplifying circuits for amplifying control signals received from control signal terminals Iw1, Iw2.

The switching elements are configured typically using power MOSFETs. The switching elements Q14, Q15 are configured so that the gates thereof are connected to the output side of the predrive circuits P14, P15, respectively, so as to open or close them depending on the output. The drain of the switching element Q14 is connected to the reset voltage terminal Vw and the source of the switching element Q15 is connected to the ground terminal. The source of the switching element Q14 and the drain of the switching element Q15 are commonly connected to the capacitor Cw.

The other end of the capacitor Cw is connected to the source of the switching element Q2 and the emitter of the switching element Q4 of the Y sustain circuit, and through a capacitor Cs also to the drain of the switching element Q1 and the collector of the switching element Q3 of the Y sustain circuit. It is therefore necessary to provide a diode 1002 between the source voltage terminal VsL and the reset circuit 102 in order to prevent backflow of the current when voltage is supplied from the reset circuit 102, in addition to the diode 103 provided between the source voltage terminal VsH and the output side (other end of the capacitor Cw) of the reset circuit 102.

The aforementioned fourth embodiment had to use elements having a voltage resistance (voltage rating) of (Vw+Vs) for composing the switching elements Q2, Q4. In contrast to this, the Y-electrode drive circuit of the fifth embodiment configured as shown in FIG. 10 makes it possible to use elements having voltage resistance only as small as [Vs/2−(−Vs/2)]=Vs for composing the switching elements Q2, Q4. The fifth embodiment is therefore successful not only in obtaining effects similar to those in the aforementioned first to fourth embodiments, but also in using low-voltage-resistance elements for the switching elements Q2, Q4 and consequently reducing the production cost.

In addition, connection of one end of the capacitor Cw with the drain of the switching element Q10 and the source of the switching element Q11 of the power recovery-circuit 602' as shown in FIG. 10 makes it possible to superpose voltage in synchronization with the output from the reset circuit 102, and this makes it possible to use an element having a small voltage resistance for the switching element Q11.

It is to be understood that the aforementioned embodiments are merely part of examples for carrying out the present invention, based on which any limitative interpretation of the technical scope of the present invention should not be made. In other words, the present invention can be practiced in various modified forms without departing from the technical spirit and or essential features thereof.

According to this invention, the second switching element having a low-saturation-voltage performance, which is connected in parallel with the first switching element having a high-speed switching performance, is brought into a conductive state when discharge current flows between the first electrode and second electrode, and this allows the discharge current to flow through the second switching element and can successfully reduce the voltage fluctuation.

On the other hand, both of the first switching element having a high-speed switching performance and the second switching element having a low-saturation-voltage performance are allowed to operate at the time of rising-up or falling-down of sustain pulses, so as to supply current mainly to the first switching element having a fast switching speed, and this successfully reduces the switching loss at the time of rising-up or falling-down of the sustain pulses.

What is claimed is:

1. A plasma display device, comprising:

a plurality of first electrodes;

a plurality of second electrodes disposed nearly in parallel with said plurality of first electrodes so as to configure display cells, each display cell including one of the plurality of first electrodes and one of the plurality of second electrodes, and so as to activate electric discharge between the one of the plurality of second electrodes and the one of the plurality of first electrodes comprising said display cell;

a first electrode drive circuit applying discharge voltage to said plurality of first electrodes; and a second electrode drive circuit applying discharge voltage to said plurality of second electrodes, wherein said first and second electrode drive circuits comprise first and second sustain circuits, respectively, outputting a sustain discharge voltage for activating electric discharge associated with light emission in said display cell, and at least one of said first or second sustain circuits has a parallel circuit in which a first switching element having a high-speed switching performance and a second switching element having a low-saturation-voltage performance are connected in parallel, thereby applying the sustain discharge voltage to both the first and second switching elements.

2. The plasma display device according to claim 1, wherein said first switching element is a power MOSFET.

3. The plasma display device according to claim 1, wherein said second switching element is an IGBT.

4. The plasma display device according to claim 1, wherein said first switching element is a power MOSFET, and said second switching element is an IGBT.

5. The plasma display device according to claim 1, wherein said second switching element is turned on at least during a period that discharge current flows between said first electrodes and said second electrodes.

6. The plasma display device according to claim 5, wherein said first switching element is a power MOSFET.

7. The plasma display device according to claim 5, wherein said second switching element is an IGBT.

8. The plasma display device according to claim 5, wherein said first switching element is a power MOSFET, and said second switching element is an IGBT.

9. The plasma display device according to claim 1, wherein said first switching element and said second switching element are comprised so that a drive voltage is applied to an electrode at different timings.

10. The plasma display device according to claim 9, wherein said first switching element is a power MOSFET.

11. The plasma display device according to claim 9, wherein said second switching element is an IGBT.

12. The plasma display device according to claim 9, wherein said first switching element is a power MOSFET, and said second switching element is an IGBT.

13. The plasma display device according to claim 9, wherein at least one of said first or second sustain circuits comprises a higher-potential-side switching circuit supplying a first potential in relation to said sustain discharge voltage to said electrodes configuring said display cell, and a lower-potential-side switching circuit supplying a second potential in relation to said sustain discharge voltage, lower than said first potential;

said higher-potential-side switching circuit and said lower-potential-side switching circuit respectively having said parallel circuit in which said first switching element and said second switching element are connected in parallel.

14. The plasma display device according to claim 13, wherein said first switching element is a power MOSFET.

15. The plasma display device according to claim 13, wherein said second switching element is an IGBT.

16. The plasma display device according to claim 13, wherein said first switching element is a power MOSFET, and said second switching element is an IGBT.

17. The plasma display device according to claim 13, wherein said first and second electrode drive circuits further comprise a power recovery circuit connected to said first electrode configuring said display cell.

18. The plasma display device according to claim 13, wherein said first and second electrode drive circuits further comprise a power recovery switch connected via a coil to said first electrode configuring said display cell.

19. The plasma display device according to claim 18, wherein said second switching element is turned on at least during a period that discharge current flows between said first electrodes and said second electrodes.

20. The plasma display device according to claim 18, wherein said first switching element is a power MOSFET.

21. The plasma display device according to claim 18, wherein said second switching element is an IGBT.

22. The plasma display device according to claim 18, wherein said first switching element is a power MOSFET, and said second switching element is an IGBT.

23. The plasma display device according to claim 1, wherein said first switching element and said second switching element almost coincide with each other in their input threshold voltage characteristics.

24. The plasma display device according to claim 1, wherein said first switching element and said second switching element are driven based on the same drive signal.

25. The plasma display device according to claim 1, wherein a switching time of said first switching element is shorter than that of said second switching element.

26. The plasma display device according to claim 13, wherein said higher-potential-side switching circuit is configured so as to supply a positive potential in relation to said sustain discharge voltage to the electrode configuring said display cell, and said lower-potential-side switching circuit is configured so as to supply a negative potential in relation to said sustain discharge voltage to the first electrode configuring said display cell.

27. The plasma display device according to claim 26, wherein said positive potential represents a voltage which equals to a half of said sustain discharge voltage above the ground level, and said negative potential represents a voltage which equals to a half of said sustain discharge voltage below the ground level.

28. The plasma display device according to claim 26, wherein said first and second electrode drive circuits further comprise a power recovery circuit connected to said first electrode configuring said display cell.

29. The plasma display device according to claim 26, wherein said first and second electrode drive circuits further comprise a power recovery switch connected via a coil to said first electrode configuring said display cell.

30. The plasma display device according to claim 29, wherein said positive potential represents a voltage which equals to a half of said sustain discharge voltage above the ground level, and said negative potential represents a voltage which equals to a half of said sustain discharge voltage below the ground level.

31. The plasma display device according to claim 30, wherein one terminal of said power recovery switch is connected via said coil to said electrode configuring said display cell, and the other terminal is connected to a ground terminal.

32. The plasma display device according to claim 13, wherein a reset voltage for initializing said display cell is superposed to the reference voltage of said lower-potential-side switching circuit during a period that said reset voltage is supplied to said first electrode configuring said display cell.

33. The plasma display device according to claim 32, wherein said first and second electrode drive circuits further comprise a power recovery circuit connected via a coil to said first electrode configuring said display cell.

34. The plasma display device according to claim 33, wherein one terminal of said power recovery switch is connected via a coil to said electrode configuring said display cell, and a voltage synchronized with said reset voltage for initializing said display cell is superposed to the other terminal of said power recovery switch during a period that said reset voltage is supplied to said first electrode configuring said display cell.

* * * * *